United States Patent [19]

Muller

[11] Patent Number: 4,697,929

[45] Date of Patent: Oct. 6, 1987

[54] PLANETARY MIXERS

[75] Inventor: Warren E. Muller, West Hempstead, N.Y.

[73] Assignee: Charles Ross & Son Company, Hauppauge, N.Y.

[21] Appl. No.: 923,845

[22] Filed: Oct. 28, 1986

[51] Int. Cl.[4] ..... B01F 7/16; B28C 1/16

[52] U.S. Cl. ..... 366/97; 74/660; 366/100; 366/206; 366/261; 366/288; 366/298; 366/299; 366/331; 366/601

[58] Field of Search ..... 366/97, 100, 197, 198, 366/206, 261, 272, 279, 283, 287, 288, 297–301, 331, 342–344, 601; 74/660

[56] References Cited

U.S. PATENT DOCUMENTS

| | | | |
|---|---|---|---|
| 2,001,036 | 5/1935 | Prince | 74/660 |
| 4,131,034 | 12/1978 | Rolf | 366/288 X |
| 4,132,484 | 1/1979 | Kimmel | 366/288 X |
| 4,380,398 | 4/1983 | Burgess | 366/298 X |
| 4,403,867 | 9/1983 | Duke | 366/601 X |
| 4,591,273 | 5/1986 | Meyer et al. | 366/288 X |

*Primary Examiner*—Timothy F. Simone

*Attorney, Agent, or Firm*—Lackenbach Siegel Marzullo & Aronson

[57] ABSTRACT

An epicyclic mixing system for materials held in a tank is provided having dual concentric sun shafts which both orbit a pair of planetary drive shafts having mixing implements at their bottom ends and act to rotate the pair of planetary drive shafts about their own axes. The two concentric shafts are connected to dual drivers through separate drive systems so that the shafts can be selectively operated at different rotating speeds.

Another epicyclic mixing system includes upper and lower housings driven about a central axis that extends through the upper housing by a sun drive shaft. The lower housing is adjustably secured to the upper housing. A first planetary drive shaft extends through the upper housing and a second planetary drive shaft extends through the lower housing. The first drive shaft is driven by a fixed sun gear about which the lower housing rotates so as to rotate the first drive shaft, which rotates the second drive shaft by way of a gear train. The housings may be adjusted so that the sweep of the mixing implements at the bottom of the planetary shafts may fit tanks of various diameters.

15 Claims, 12 Drawing Figures

FIG. 4
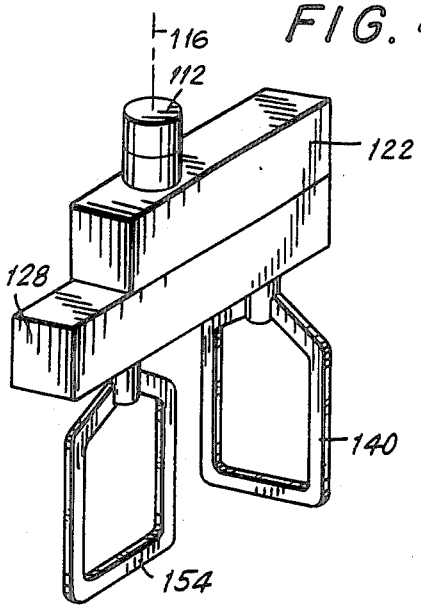
FIG. 5
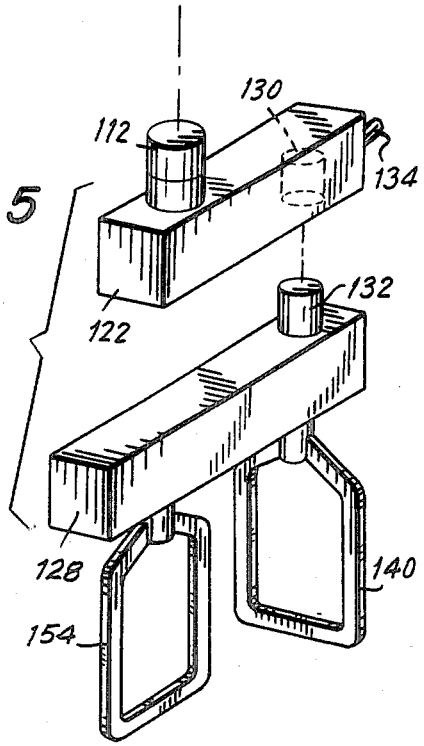
FIG. 6
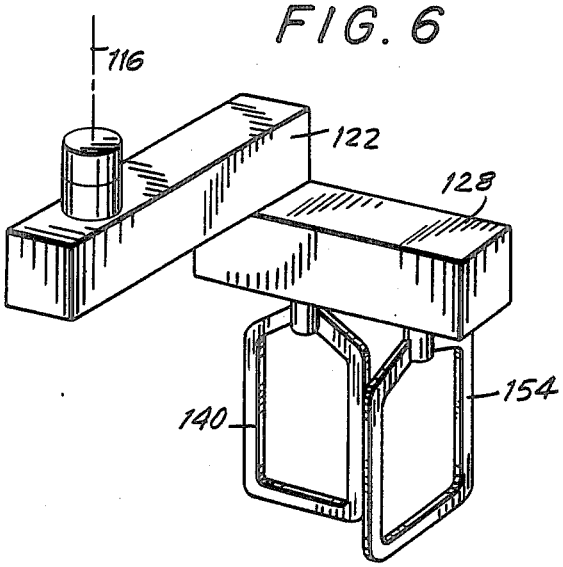
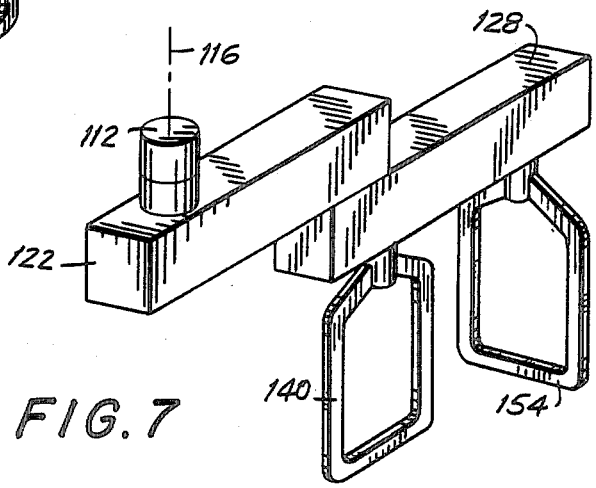
FIG. 7

PLANETARY MIXERS

BACKGROUND OF THE INVENTION

This invention relates to mixers for liquids and solids in a tank, and more particularly to the art of planetary type mixers.

The mixers under discussion here are of those type suited to a wide range of liquid and solid mixing applications, from simple mixtures to sophisticated reactions involving high temperature, vacuum, or internal pressure.

One type of mixer in common use is the multiple agitator mixer, which has several types of agitators that can operate simultaneously or independently in a single can, or tank, so that a selected combination of agitations covering a range of low to high viscosity consistencies can be applied when two or more compounds each having substantially different viscosities are being mixed. Each agitator rotates about its own axis and an anchor agitator rotates within the tank about a central axis. Two or three agitators used in a single mixer can include two or three of the following: a high speed mixer-emulsifier, a high speed disperser, or a standard anchor agitator used in selected combinations. Applications are extensive in the adhesives, cosmetics, chemical, food, pharmaceutical and plastics industries. Tank sizes range between 1 gallon to 4000 gallons. Rotational agitator tip speeds range approximately between 2500 FPM to 5000 FPM for a disperser, 2500 FPM to 5000 FPM for an emulsifier, and 150 FPM to 450 FPM for an agitator. Each shaft is driven by a separate driver and a separate gear box for varying speeds of each drive shaft. This type of mixer is described in a brochure entitled "VersaMix" published by Charles Ross & Son Company, 710 Old Willets Path, Box 12308, Hauppauge, New York 11788-0615.

Another type of mixer in common use is the double planetary mixer having two stirrer blades. During the mixing cycle, two rectangularly shaped stirrer blades revolve about the tank on a central axis. Simultaneously, each blade revolves on its own axis at approximately the speed of the central rotation. The double planetary mixer is used for a wide range of liquid and solid mixing applications, including plastisols, bulk molding compounds, pharmaceutical granulations, ceramics, caulking compounds, composites, magnetic coatings, precious metals, and dental composites. Two planetary stirrers are used. This type of mixer is used in both laboratory and production mixers. It is often used in vacuum applications. Can size ranges between 1 quart and 500 gallons. Planetary blade speeds range approximately between 10 rpm to 100 rpm. This type of mixer has one shaft driven by one driver and has one gear box for varying speed. The rotational speed of each planetary stirrer blade is the same. This type of mixer is described in a brochure entitled "Double Planetary Mixers" published by Charles Ross & Son Company, 710 Old Willets Path, Box 12308, Hauppauge, New York 11788-0615.

Problem with each of the described mixing systems exist. These problems are basically three. First, the multi-agitator mixing system and the mixing tank must be dimensioned to fit one another. Second, a separate driver is needed for each shaft in the multi-agitator system. Third, the planetary mixer system uses two identical stirrers that must rotate at the same speed.

SUMMARY OF THE INVENTION

It is an object of the present invention to provide a planetary mixer system that overcomes the problems of the present planetary stirrer and multi-agitator systems described above.

It is another object of the present invention to provide a planetary mixer system that has a dual concentric drive that has two drivers that power two concentric drive shafts each capable of rotating its own selected stirrer or agitator at a selected speed independent of the speed of the other stirrer or agitator.

It is another object of the present invention to provide a planetary mixer system that has two or more stirrers that can be arranged to fit various sizes of tanks.

It is another object of the present invention to provide a means to be quickly able to change or replace the agitators on a planetary mixer.

In accordance with these and other objects, there is provided an epicyclic mixer system that includes an orbit drive shaft that is rotated by a driver about a central axis of rotation and that extends into a stationary top housing and is locked to a bottom housing that also is rotated about the central axis of rotation. First and second planetary shafts each having a stirrer at their bottoms are rotatably mounted in the bottom housing and are carried orbitally about central axis 14 when the orbit drive shaft is rotated. A fixed first sun gear formed around the outer surface of the stationary top shaft meshes with a first planetary gear fixed to the first planetary shaft so that the first planetary shaft is rotated about a first planetary axis of rotation when th orbital drive shaft is rotated. A central drive shaft rotatably mounted in a cylindrical bore in the orbit drive shaft is connected to the same driver that drives the orbit drive gear; each drive shaft is connected to the driver through different gear boxes that are controlled so that each drive shaft can be driven at a speed independent of the other. A second sun gear mounted to the central drive shaft is meshed with a second planetary gear that is fixed to the second planetary shaft so that the second planetary shaft is rotated about a second planetary axis of rotation by way of the rotation of the second sun gear and the second planetary gear. The top housing remains immobile during these movements. In the preferable, but not manditory embodiment, the planetary axes of rotation are equally distanced from the central axis so that each orbits the central axis on the same circle. If the center distances are unequal, the orbits would not be the same but would be concentric.

The embodiment described above includes a planetary driver that orbits and rotates a slow or medium speed shaft equipped with a paddle or similar type stirrer. The embodiment also includes another driver that independently drives a high speed shaft equipped with one or more high speed blades. The dual drive system permits the slow or medium speed shaft and the high speed shaft to be oontrolled or varied independently.

The advantage of this mixing system just described is that it is able to mix components of widely different viscosities more efficiently by using within the same mixing tank more than one selected effective mixing device. For example, the best device for mixing high viscosity materials is a medium speed paddle, and the best device for mixing low viscosity materials is a high speed blade. With the planetary action a 100% of the mix tank volume is covered by all of the mixing devices during the complete mixing cycle. Some mixers presently on tne market use multiple mixing devices, but none move all of the mixers through the mixture and through a 100% of the fix tank volume.

Another embodiment of the invention includes adjustably fixed first and second housings rotatable about a first axis passing through the first housing, a sun drive shaft positioned in and secured to the first housing and rotatable about its own axis being the central axis. The sun drive shaft orbits the first and second housings about the central axis. A driver fixed to a support or frame rotates the sun drive shaft about the central axis. A first planetary shaft is positioned in the second housing and is rotatable about its own first planetary axis which is spaced from a parallel to the central axis. The first planetary axis has opposed ends including one end external of the second housing. The first planetary shaft is orbited with the second housing about central axis at a radial first distance from the central axis. A first planetary gear is meshed with a fixed sun gear, the first planetary gear being positioned in the second housing and connected to the other of the ends of the first planetary shaft. The fixed sun gear is positioned in the first housing, is secured to the support means, is aligned with the sun drive shaft, and is connected to said the drive shaft. The sun drive shaft orbits the first and second housings along with the first planetary shaft in one circular direction about tne central axis while simultaneously the first planetary gear is being driven by the fixed sun gear to rotate the first planetary shaft about the first planetary axis in the same circular direction. A second planetary shaft positioned in the second housing is rotatable about its own second planetary axis spaced from and parallel to the central axis and the first planetary shaft. The second planetary shaft has opposed ends including one end external of the second housing. The second planetary shaft is orbited with the second housing about the central axis at a second radial distance. A drive gear, an idler gear meshed with the drive gear, and a second planetary gear meshed with the idler gear, A drive gear meshed with an idler gear is positioned in the second housing and connected to the first drive shaft. The idler gear is positioned in the second housing, and a second planetary gear is connected to the other of the ends of the second planetary shaft. The first planetary shaft drives the idler gear in an opposite circular direction, and the idler gear drives the second planetary gear to rotate about the second planetary axis in the same circular direction as the first planetary axis. The first housing forms a cylindrical socket and the second housing has a cylindrical core portion rotatably and removably positioned in the socket. The first housing has a wall portion defining a part of the socket. The wall forms a threaded locking hole, and the core portion forms a plurality of locking recesses each adapted to be aligned with the locking hole. A threaded locking pin is positioned in the locking hole has an inner end removably positioned in a selected locking recess. The core portion is rotatable in the socket when the locking pin is withdrawn from the selected locking recess. The core portion is rotatable in the socket to a new alignment for positioning of the inner end of the locking pin in another selected recess. The second housing may be adjusted so as to change the radial first and second distances to fit the dimensions of tanks of different diameters. Another second housing may be likewise adjustably attached to the first housing so that three or four mixing implements may be included in the system.

The second embodiment just described includes a planetary drive shaft that orbits one of more sockets that are suitable for receiving planetary or other housings containing additional drive shafts that accommodate paddle stirrers or other mixing configurations. These secondary housings are radially hinged so that they have a flexibility as to choice of orbit. The sockets provide a flexible mount for ease of changing or replacing the mixing system.

The advantage of the second embodiment just described is that it provides a flexible type of mixing system that is able to operate in any diameter tank within its geometric scope and still is able to mix through a 100% of the volume of that mix tank. Prior art mixing systems operate through a fixed orbit. For such prior art systems, a tank of specific diameter is required if the mixing system is capable of mixing through a 100% of the volume of the tank. Also, such prior art mixing systems are also an integral part of the machine and any changes in the system are difficult, if even possible.

The described advantages of the second embodiment release planetary mixing systems from the confines of a mixing tank diameter restraint. With this constraint lifted, this single mixing system could be used in place of many different sized mixers, which now use many different diameter tanks. For example, a product line of three of these mixers could cover from one to 300 gallon sizes. At present, a product line of twelve mixers is required to cover this range of sizes.

Both of the above-described systems can be incorporated in a single combined mixing system. In such a combined hybrid system, all of the advantages of the two described systems would be applicable.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein; such other embodiments or modifications are intended to be reserved especially as they fall within the scope and spirit of the subjoined claims.

BRIEF DESCRIPTION OF THE DRAWINGS

FIG. 4 is is a simplified perspective view of the stirrer system shown in FIG. 3 with the planetary section overlapping the rotary section;

FIG. 5 is an exploded perspective view of the mixer system shown in FIG. 4 being disassembled;

FIG. 6 is a perspective view of the planetary mixer system shown in FIG. 5 with the rotary section rotated 90° relative to the planetary section;

FIG. 7 is a perspective view of the mixer system shown in FIG. 5 with the rotary section extending longitudinally from the planetary section;

DESCRIPTION OF THE PREFERRED EMBODIMENTS

Figure 1:
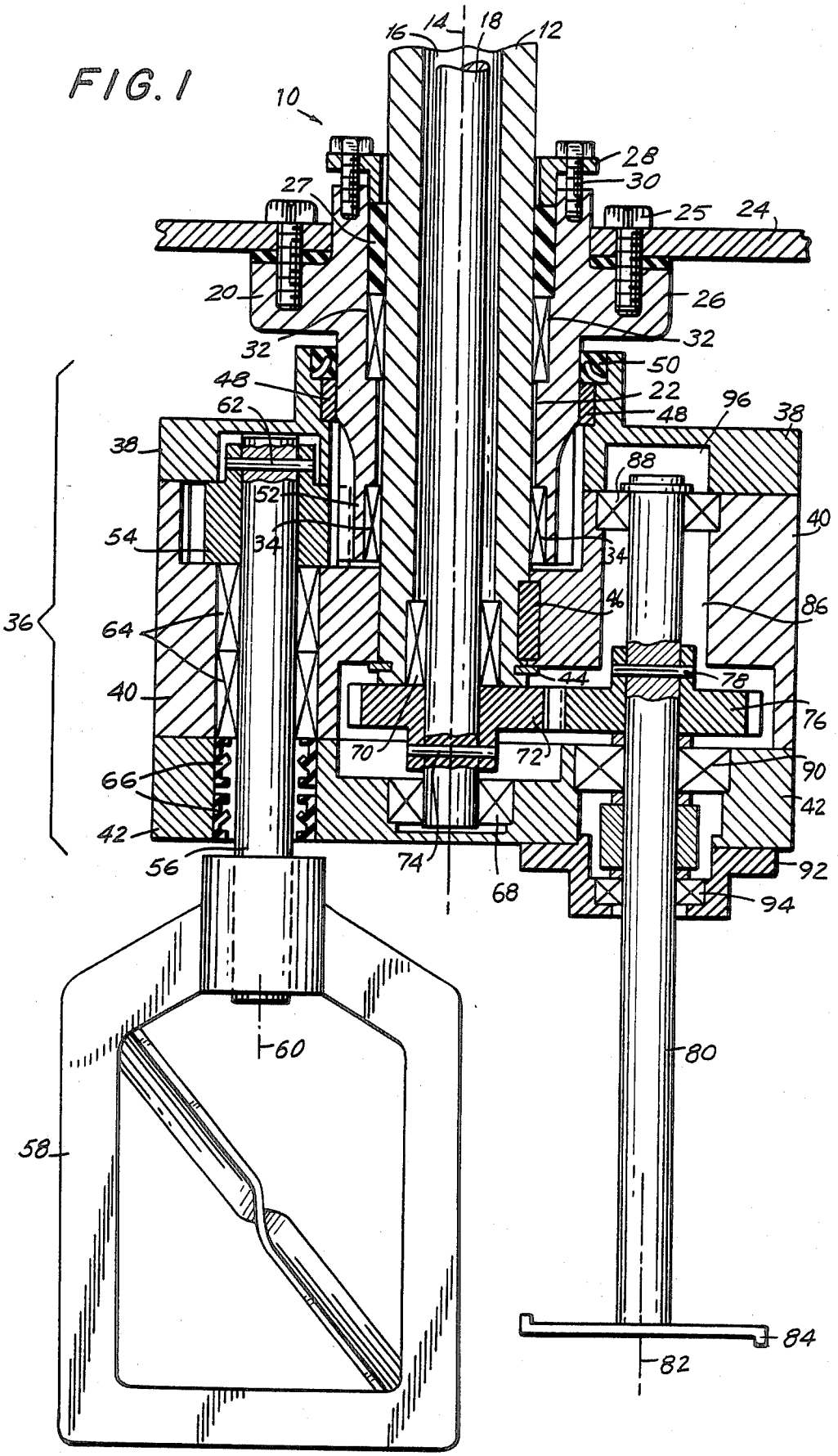
FIG. 1 is a sectional view of a planetary mixer having a central stirrer drive and an orbit drive.

Reference is now made to the drawings in which identical or similar elements are designated by the same reference numerals.

Figure 2:
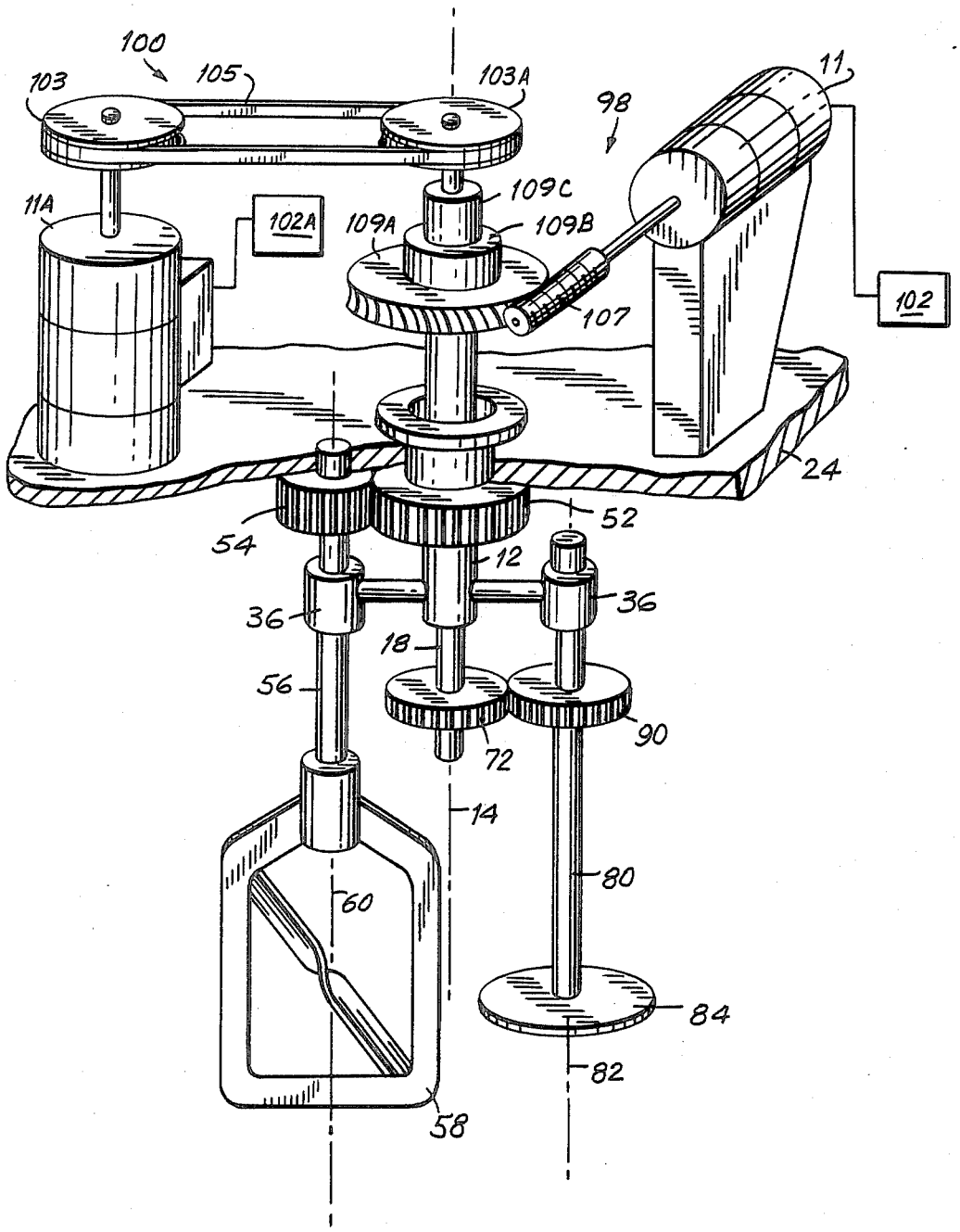
FIG. 2 is a perspective illustration of the planetary mixer shown in FIG. 1 including driver, gear boxes, and controller.

An epicyclic mixer system 10 shown in FIGS. 1 and 2 includes first sun drive shaft, or orbit drive shaft, 12 that is rotated about its own vertical central axis of rotation 14 by a first driver 11 (FIG. 2). Orbit shaft 12 has an axial bore 16 in which a second sun drive shaft, or central drive shaft, 18 is rotatably positioned and rotatable about its own axis of rotation 14; central drive shaft 18 is slightly spaced from the inner surface of bore 16 of orbit shaft 12 and is driven by a second driver 11A (FIG. 2). A generally cylindrical top housing 20 having upper and lower ends has a vertical cylindrical central bore 22 axially aligned with central axis 14 in which orbit shaft 12 is positioned. The upper end of orbit shaft 12 is connected to the driver, and the opposed lower end extends beyond the lower end of top housing 20. Top housing 20 is fixed to a stationary mixer housing 24 shown in fragment in FIG. 1 by bolts 25 which extend into an upper ringed flange 26 of top housing 20 thus making top housing immobile. An annular gasket 29 is positioned between ringed flange 26 and housing 24. An annular seal 27 positioned between the top end of top housing 20 and orbit drive shaft 12 is held in place by a packing gland adjusting member 28, which is secured to the upper rim of top housing 20 by bolts 30. Upper and lower bearings 32 and 34, respectively, are positioned at the upper and lower housing portions of top housing 20 between top housing 20 and orbit drive shaft 12. A generally cylindrical bottom housing 36 that includes a generally cylindrical upper housing portion 38, a middle housing portion 40, and a lower housing portion 42, which are secured to one another by means known in the art, such as welding or bolting, is supported by support ring 44, which is positioned in a circular groove at the bottom or orbit drive shaft 12. The bottom surface of the inner side of middle housing portion 40 is supported by snap ring 44 thus giving support to the entire bottom housing 36. Orbit drive shaft 12 locks bottom housing 36 to itself by way of a key lock 46 located at the bottom of orbit drive shaft 12 and at the inner wall of middle housing portion 40. Upper housing portion 38 forms a central cylindrical bore aligned with central axis 14 in which top housing 20 is positioned. An annular bearing 48 is located between the inner surface of the bore at the top of upper housing portion 38 and the outer surface of the midportion of top housing 20. An annular seal 50 overrides bearing 48.

A horizontally aligned fixed first sun gear 52 located at the lower end of top housing 20 is formed from gear teeth formed from and extending annularly around the outer surface of housing 20. Fixed first sun gear 52 meshes with a first horizontally aligned planetary gear 54, which is connected to the top end of a vertical first planetary shaft 56 having a mixing implement, shown here as a stirrer blade 58, at the bottom end. First planetary shaft 56 rotates about its own planetary axis of rotation 60 spaced from and parallel to central axis 14. A pin 62 connects first planetary shaft 56 with first planetary gear 56. Midportion 40 of bottom housing 36 encircles first planetary gear 54 and orbit drive shaft 12 and has a cylindrical bore axially aligned with central axis 14 through which orbit shaft 12 is positioned. It is this bore in which key lock 46 is located. First planetary shaft 56 rotates within a vertical cylindrical bore formed in middle housing portion 40 of bottom housing 36. Bearings 64 are positioned around first planetary shaft 56 in the bore of middle housing portion 40. Lower housing portion of 42 of bottom housing 36 covers the bottom end of central shaft 18 and extends radially outwardly where it has a central cylindrical recess axially aligned with central axis 14 that rotatably positions first planetary shaft 56. Annular seals 66 are positioned around first planetary shaft 56 in the bore of lower housing portion 42. Bearings 68 are positioned around the bottom end of central drive shaft 18 in the central recess of lower housing portion 42. Bearings 70 are positioned in bore 16 between central drive shaft 18 and orbit drive shaft 12.

A horizontally aligned second sun gear 72 secured to the bottom portion of central shaft 18 by a pin 74 is meshed with a horizontal second planetary gear 76, which in turn is secured by a pin 78 to a second planetary shaft 80 that rotates about its own planetary axis of rotation 82 that is spaced from and parallel to central axis 14 and diametrically opposite from planetary axis of rotation 60. Planetary axis of rotation 82 is preferably, as shown, the same radial distance from central axis 14 as is planetary axis of rotation 60, but this distance is not mandatory. A mixing implement, shown here as a high speed disperser 84, is attached to the bottom end of second planetary shaft 80. The upper portion of second planetary shaft 80 is positioned in a bore 86 in middle housing portion 40 diametrically opposite the bore in middle housing portion 40 for first planetary shaft 56. Upper bearings 88 positioned in bore 86 rotatably support second planetary shaft 80. Second planetary shaft 80 extends through a bore in bottom housing portion 42 where lower bearings 90 rotatably support second planetary shaft 80. A bottom bearing housing 92 secured to the bottom side of bottom housing 36 specifically at the bottom side of a bottom housing portion 42 has a bore through which second planetary shaft 80 extends and supports the upper and lower portions of a mechanical seal 94. Upper housing portion 38 covers the top end of second planetary shaft 80, which is positioned in a recess 96 of the upper housing portion.

Orbit drive shaft 12 and central drive shaft 18 are driven by drivers 11 and 11A, preferably motors, which have their power transmitted through separate drive systems 98 and 100, respectively, for first and second planetary shafts 58 and 80, respectively, as shown in FIG. 2, so that each shaft can be rotated at a selected speed different from the other. Thus, first planetary shaft 56, which is rotationally geared to orbit drive shaft 12 by way of fixed first sun gear 52 and first planetary gear 54, can be rotated at a selected rotational speed other than the selected rotational speed of second planetary shaft 80, which is rotationally geared to central drive shaft 18 by way of second sun gear 72 and second planetary gear 76. Drive system 100 is a high speed system that includes a pair of pulley wheels 103 and 103A, connected to the drive shaft of motor 11A and shaft 18, respectively, with a pulley 105 mounted to the pulley wheels. Drive system 102 is a medium or slow speed system that includes a worm gear comprising a worm 107 connected to the drive shaft of motor 102 and a series of worm wheels 109A, 109B, and 109C of successivly reduced diameters that are connected to shaft 12, so that the speed of shaft 12 can be selectively reduced. Bottom housing 36, which acts as the planet driver of shafts 56 and 80 is schematically shown in FIG. 2 as indicated by the numeral 36.

Central drive shaft 18 rotates second planetary shaft 80 about second planetary axis of rotation 82 by way of the rotation of second sun gear 72 and second planetary gear 76. Simultaneously, orbit drive shaft 12 rotates bottom housing 36 orbitally about central axis 14 so that first planetary shaft 60 and second planetary shaft 80 are carried around central axis 14 in a circle aligned with axes of rotation 60 and 82. Top housing 20 remains immobile during these movements. Finally, also simultaneously, when orbit drive shaft 12 rotates bottom housing 36 about axis 14, first planetary gear 54, being meshed with fixed first sun gear 52, is rotated so as to rotate first planetary shaft 56 about first planetary axis of rotation 56. In the preferable embodiment illustrated, axes 60 and 82 are distanced the same from central axis 14 so that each orbits central axis 14 on the same circle. It is possible for axes 60 and 82 to be at different distances from central axis 14. If orbit drive shaft 12 and central shaft 18 are being rotated in a clockwise direction about central axis 14, for example, first planetary shaft 56 and second planetary shaft 80 are rotated in a counterclockwise direction about their axes of rotation 60 and 82. Stirrer 58 and disperser 84 mix the compounds in the tank in which they are operating by planetary rotational movements about their own axes and by simultaneous orbital motion around the tank about a central axis. Controllers 102 and 102 attached to motors 11 and 11A, respectively, regulate the speed of the motors.

If desired, first and second planetary shafts 56 and 80 along with their stirrer 58 and disperser 80 can be suitably removed from the system and replaced with other types of mixers as is well known in the art of other types of mixers.

Thus, for example, high speed disperser 80 can be replaced with a second stirrer blade, which can be made to rotate at the same speed as stirrer blade 56 by adjustment of the central drive shaft gear box 100 so as to decrease the rotational speed of orbit drive shaft 12. Likewise, stirrer blade 56 can be replaced with a second disperser, which can be made to rotate at the same speed as disperser 80 by adjustment of the orbit drive shaft gear box 98 so as to increase the speed of orbit drive shaft 12.

Figure 3:
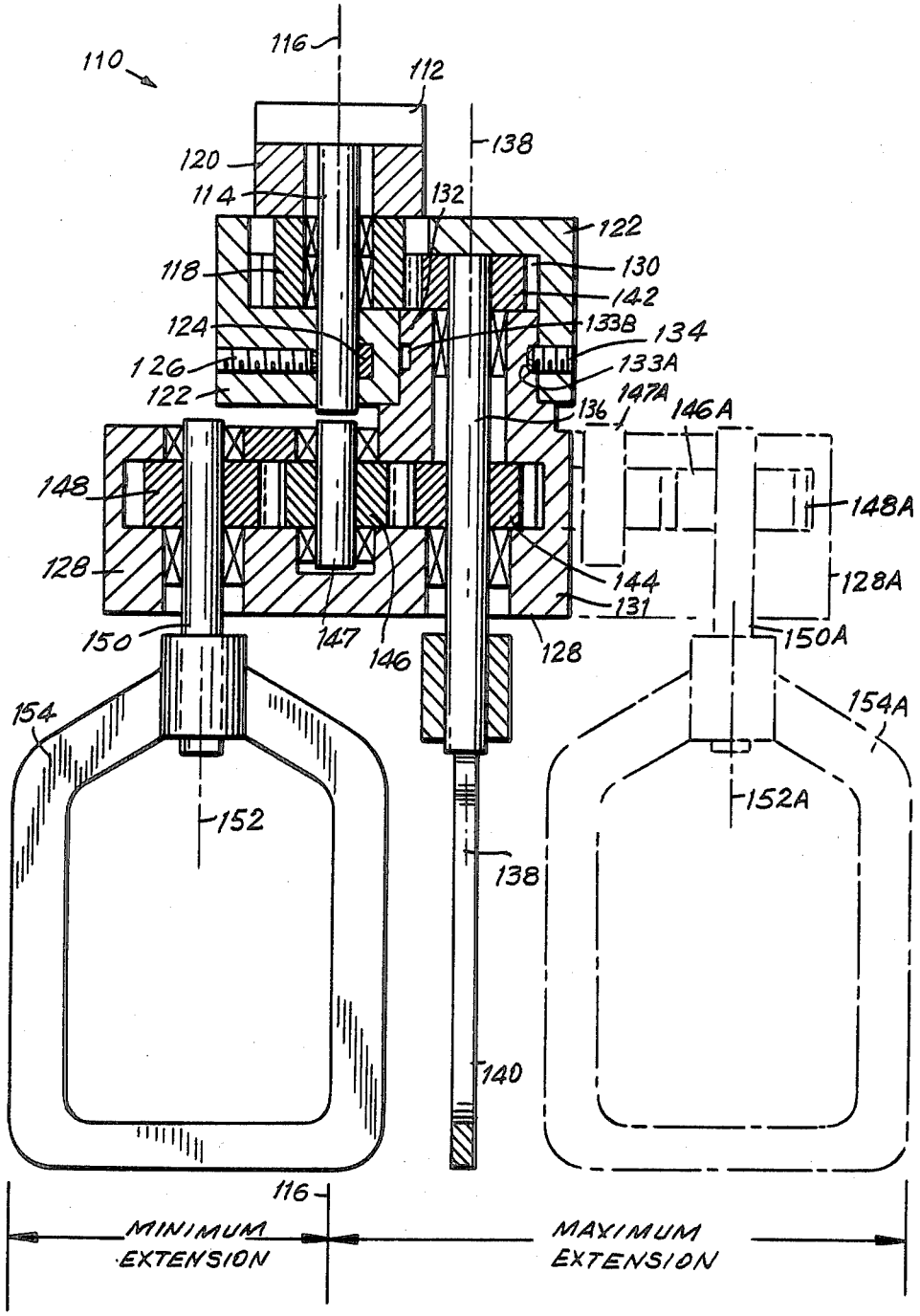
FIG. 3 is a sectional view of a planetary mixer having two planetary stirrers that can be adjusted to accommodate mixing tanks of different sizes.

An adjustable epicyclic planetary mixer system 110 shown in sectional view in FIG. 3 includes a driver 112 that rotates a sun drive shaft 114 about its own vertical sun axis of rotation 116. Sun shaft 114 is rotatably mounted in a bore through the axial center of a horizontal fixed sun gear 118, which is secured to a mounting 120 having a bore through which sun shaft 114 also rotatably extends; mounting 120 is integral with a frame or main housing and to driver 112, which is also fixed to the main housing or frame. An upper housing, or planetary section, 122 positioned under fixed sun gear 118 has a bore through which sun shaft 114 extends. Planetary section 122 is locked to sun shaft 114 by key lock 124 and by a set screw 126 so that when sun shaft 114 is rotated planetary section 122 is rotated. Planetary section forms a cylindrical socket 130 having a vertical axis. A lower housing, or rotary section, 128 includes a main body 131 and a cylindrical pin section, or core segment, 132 connected to and extending upwardly from main body 131. Cylindrical core segment 132 is fitted into and axially aligned with socket 130, and rotary section 122 is locked to planetary section 122 by a horizontal threaded locking screw, or pin, 134 that is threaded through a threaded hole in the side of the socket wall and that extends into a locking recess 133A in core segment 130. Thus, rotary section 128 is rotated when planetary section is rotated. As will be discussed in more detail later, rotary section 128 can be unlocked from planetary section by unscrewing the the end of locking pin 134 from locking recess 133A of socket 122 so that core segment 132 can be rotated in socket 122 and rotary section 128 can be rotated relative to planetary section 122 to a new position and thereupon locking pin 134 can be screwed into another locking recess of planetary section 122 such as locking recess 133B located at 180° from locking recess 133A. Locking pin 134 can optionally be several locking pins set around the periphery of the cylindrical wall of socket 130 into the recesses of core segment 132.

A first planetary shaft 136 having an upper portion extending through rotating hinged section 128 into socket 130 of planetary section 122 is rotatable about its own first planetary axis of rotation 138 that is parallel to sun axis of rotation 116. A stirrer 140 is connected to the bottom portion of first planetary shaft 136. A first planetary gear 142 positioned in socket 130 and fixed to the upper portion of first planetary shaft 136 is meshed with sun gear 118. A planetary drive gear 144 positioned in main body 131 of rotary section 128 is fixed to the lower portion of first planetary drive shaft 136. An idler gear 146 connected to a short idler shaft 147 positioned in main body 131 is meshed with driver gear 144 and with a second planetary gear 148 also positioned in main body 131 and fixed to the upper portion of a second planetary shaft 150 that extends downwardly from main body 131 and is rotatable about its own second planetary axis of rotation 152 that is parallel to sun axis of rotation 116. A second stirrer 154 is connected to the bottom portion of second planetary shaft 150. The arms of first and second stirrers 140 and 154 overlap slightly. Because both stirrers rotate at the same speed, operating from the same first planetary shaft 136, the arms never collide since they are placed in interlocking relationship. In order for first and second planetary shafts 140 and 154 to rotate at the same speed, both of the gears meshed with idler 146 are to be of the same diameter, namely, gears 144 and 148.

The rotational movements of stirrers 140 and 154 about their own axes is accomplished as follows. Driver 112 rotates sun shaft 114 which in turn rotates planetary section 122 in a first rotational direction so that first planetary gear 142, which is carried by planetary section 122 so as to shift its radial alignment with sun shaft 114, rotates first planetary shaft 136 and first stirrer 140 in an opposed second rotational direction about its own first planetary axis of rotation 138. This rotational movement of first planetary shaft 136 rotates lower drive gear 144 in the same second rotational direction so that drive gear 144 rotates idler gear 146 in the first rotational direction so the idler gear rotates second planetary gear 148 along with second stirrer 154 in the second rotational direction about its own second planetary axis of rotation 152. Thus the two stirrers 140 and 154 are rotated by their planetary shafts 138 and 152 about their own axes of rotation.

Figure 8:
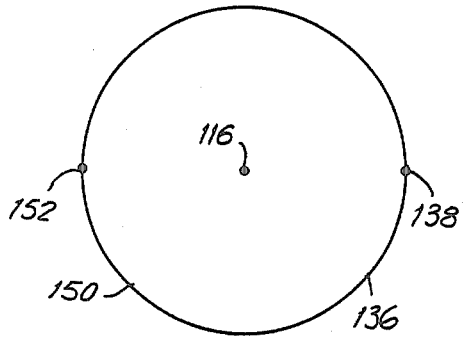
FIG. 8 is a schematic top view illustrating the path of the two stirrers in the configuration shown in FIG. 3.

The planetary movements of stirrer 140 and stirrer 154 are as follows. Sun shaft 114 rotates planetary section 122 and rotary section 128 about sun axis of rotation 116 so that first planetary shaft 136 and second planetary shaft 150 along with first stirrer 140 and second stirrer 154 are moved in a circle about sun axis of rotation 116 simultaneously with their rotation about their first planetary axis of rotation 138. Because first and second axes of rotation 138 and 152 are at the same radial distance from sun axis of rotation 116, the two stirrers follow the same circle of rotation, as is seen in FIG. 8.

The position of second planetary shaft 150 and second stirrer 154 when rotary section 128 is unhinged from planetary section 122 and rotated 180° and rehinged in a manner that will be discussed below is shown in phantom line in FIG. 3. Second planetary shaft 150 is indicated as 150A, second stirrer 154 is indicated as 154A, second planetary axis of rotation 152 is indicated as 152A, and so on with other analogous elements indicated in a similar manner.

The minimum extension of mixer system 110 is indicated in FIG. 3 as being when second axis of rotation 152 is nearest sun axis 116 in its orbit, and the maximum extension of the system is indicated in FIG. 3 as being when second axis of rotation 152 is farthest from sun axis 116 in its orbit. The minimum and maximum extensions are achieved when rotary section 128 and planetary section 122 are configured as shown in FIGS. 4 and 7, respectively, as will be described.

In summary, mixer system 110 includes the following simultaneous rotational movements of stirrers 140 and 154: (1) rotational movements about their own axes, and (2) a circular planetary orbit of first stirrer 140 and second stirrer 154 in a circular movement about sun axis 116.

As discussed earlier, rotary section 128 can be removed from planetary section 122 by unscrewing locking pin 134 from locking recess 133A in core segment 132 and thereupon sliding core segment 132 from socket 130. FIG. 4 shows mixer system 110 in a perspective view with rotary section 128 in the position relative to planetary section 122 shown in FIG. 3, that is, with planetary section 122 aligned with and overlying rotary section 128. First and second stirrers 140 and 154 are rotated about sun axis of rotation 116. FIG. 5 shows rotary section 128 unhinged from planetary section 122 after locking pin 134 has been removed from core segment 132 by unthreading locking pin from the thread hole in the wall of planetary section 134.

FIG. 6 shows mixing system 110 with rotary section 128 hinged with planetary section 122 at a 90° angle relative planetary section 122. After core segment 132 has been inserted into socket 130 in the assembly shown in FIG. 6, locking pin 132 is threaded inwardly until the end of the locking pin enters another locking recess in core segment 132 similar to the one shown in FIG. 3 but at 90° to that recess. Rotation of first and second stirrers 140 and 154 about sun axis of rotation 116 results in a wider maximum extension, or orbital sweep, of the stirrers than the assembly shown in FIG. 5, since the radial sweep from sun axis of rotation 116 to far stirrer 154 at its widest point is greater than the radial sweep of stirrer 154 from sun axis 116 in the assembly shown in FIG. 4.

FIG. 7 shows mixing system 10 with rotary section 128 reassembled with planetary section 122 aligned with rotary section 128 in accordance with the same general manner of hinging rotary section 128 to planetary section 122 described relative to FIG. 6 but in elongated extension relative to rotary section 128 with locking pin 134 being positioned locking recess 133B shown in FIG. 3 in core segment 132 located 180° from locking recess 133A shown in FIG. 3. Rotation of stirrers 140 and 154 about sun axis 116 results in a wider maximum orbital sweep of the stirrers than the assembly shown in FIG. 6, since the radial sweep from sun axis 116 to stirrer 154 is greater than the radial sweep of stirrer 154 relative to sun axis 116 shown in FIG. 6. Planetary section 122 and rotary section 128 can be placed in a plurality of selected rotational positions as exemplified by the positions shown in FIGS. 5, 6, and 7 with the locking recess in core segment 132 being positioned to accept locking pin 134 at those positions.

Figure 9:
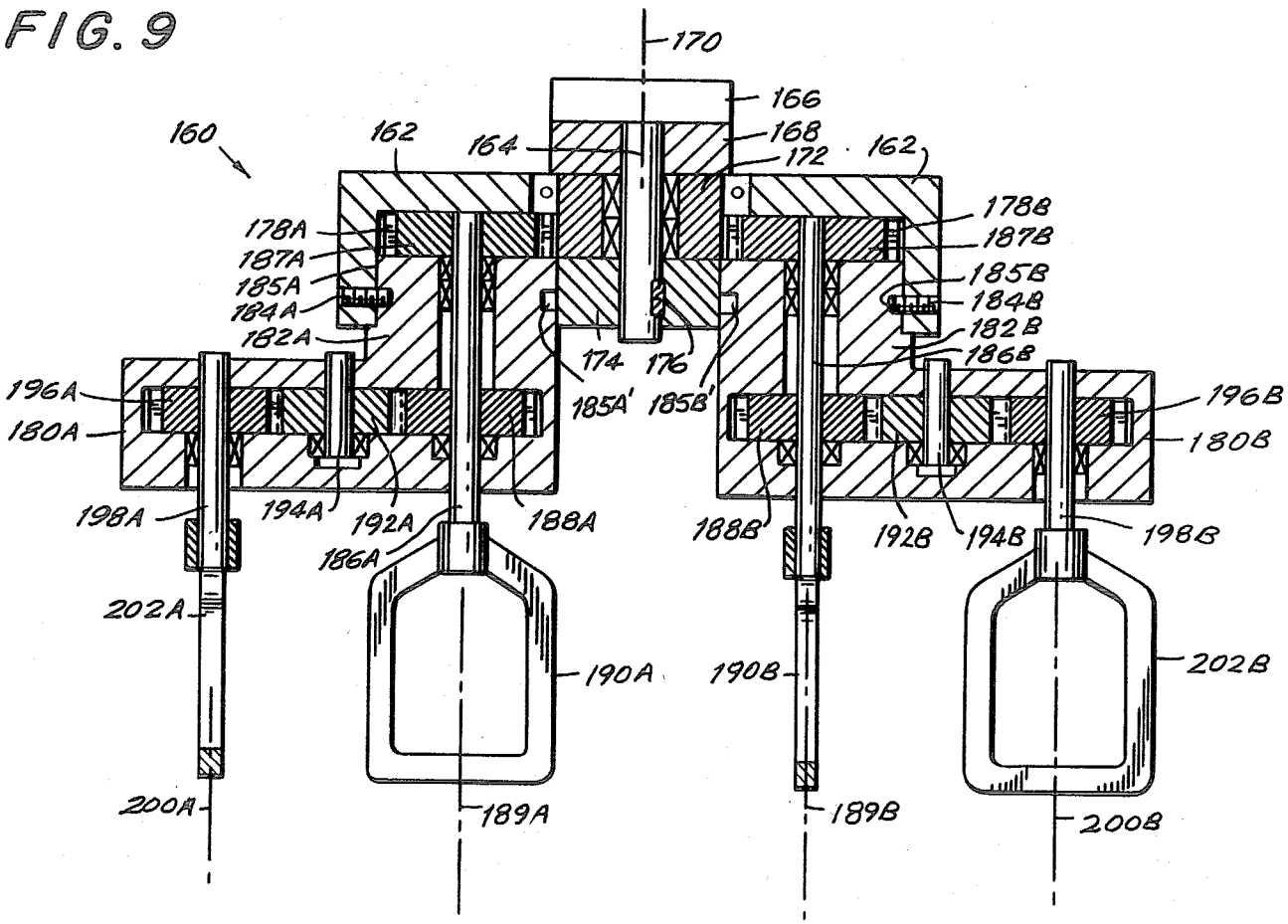
FIG. 9 is a sectional view of a multiple double planetary mixer system.
Figure 10:
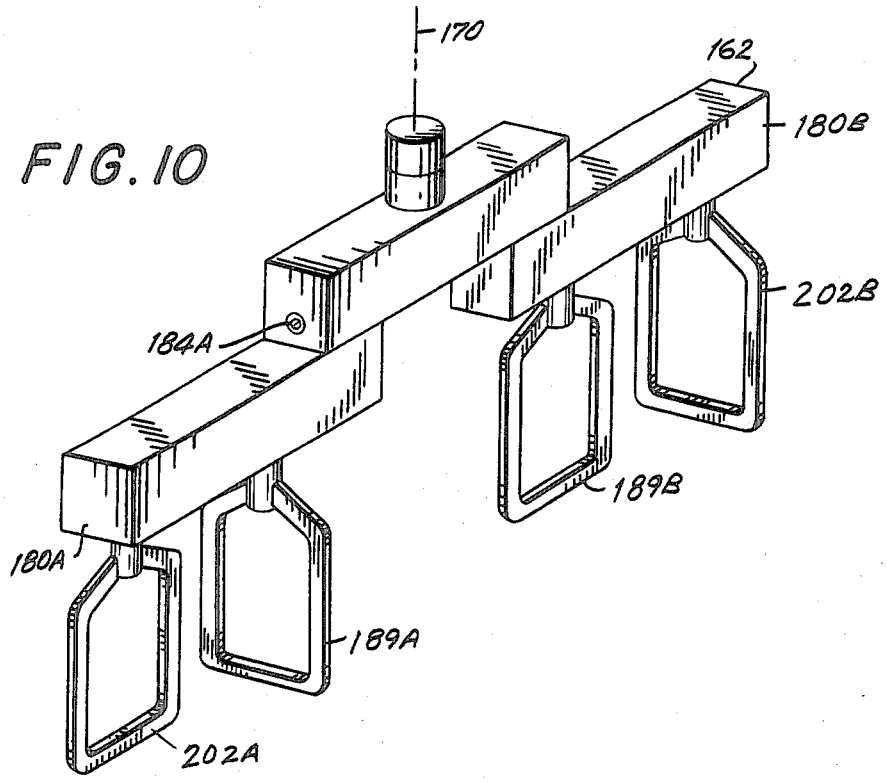
FIG. 10 is a perspective view of the multiple double planetary mixer system in the configuration shown in FIG. 9.

A mixer system 160 adapted from mixer system 110 just described is shown in FIG. 9 in sectional view and in FIG. 10 in perspective view. System 160 includes an upper housing, or planetary section 162 through which a vertical sun shaft 164 extends. A driver 166 connected to a fixed mounting 168 rotates sun shaft 164 about its own sun axis of rotation 170. A fixed sun gear 172 positioned in planetary section 162 is fixed to mounting 168. Sun shaft 164 rotatably extends through a bore in mounting 168 and the axial center of fixed sun gear 172. Sun shaft 164 extends through a bore formed at a bottom wall 174 of planetary section 162 and is attached to planetary section 162 by a key lock 176 at bottom wall 174. Rotation of sun shaft 164 results in rotation of planetary section 162.

Planetary section 162 forms two opposed, cylindrical sockets 178A and 178B, which are located at opposite ends of planetary section 162 equidistant from sun axis of rotation 170. A pair of bottom housings, or rotary sections, 180A and 180B are connected to planetary section 162 by a pair of cylindrical core segments 182A and 182B, which extend upwardly from rotary sections 180A and 180B, respectively, and which are positioned in a pair of cylindrical sockets 178A and 180B, respectively. Horizontal, threaded locking pins 184A and 184B extend through the side walls of planetary section 162 which form sockets 178A and 178B, respectively, and into locking recesses 185A and 185B in core segments 182A and 182B, respectively, so that rotary sections 180A and 180B are fixed to planetary section 162. Thus, when planetary section 162 is rotated, rotary sections 180A and 180B are also rotated. Locking recesses 185A' and 185B' located diametrically opposite locking recesses 185A and 185B, respectively, shown in FIG. 9 provide alternate locking recesses for receiving locking pins 184A and 184B when rotary sections 180A and 180B are unhinged from planetary section.

Vertical first planetary shafts 186A and 186B rotatably positioned in rotary sections 180A and 180B, respectively, are fixed to planetary gears 187A and 187B, respectively, positioned in rotary sections 180A and 180B, respectively, at their top portions, and to drive gears 188A and 188B, respectively, also positioned in rotary sections 180A and 180B, respectively, at their bottom portions. First planetary shafts 186A and 186B rotate about their own first planetary axes of rotation 189A and 189B, respectively. First stirrers 190A and 190B are connected to the bottom ends of first planetary shafts 186A and 186B, respectively. Planetary gears 187A and 187B are meshed with fixed sun gear 172. Idler gears 192A and 192B, which are positioned in rotary sections 180A and 180B, respectively, and are fixed to vertical idler shafts 194A and 194B, are meshed with drive gears 188A and 188B, respectively. Second planetary gears 196A and 196B positioned in rotary sections 180A and 180B, respectively, are fixed to vertical second planetary shafts 198A and 198B, respectively, which extend through the horizontal end portions of rotary sections 180A and 180B, respectively. Second planetary shafts 198A and 198B rotate about their own second planetary axes of rotation 200A and 200B. Second stirrers 202A and 202B are connected to the bottom ends of second planetary shafts 198A and 198B. All the stirrers, 190A, 190B, 202A, and 202B, rotate at the same speed and overlap during rotation with their arms overlapping so as to avoid striking. All the planetary, drive, and idler gears, 187A, 187B, 188A, 188B, 192A, 192B, 196A, and 196B are of the same diameter. Variations in the diameter of the gears contained in the rotary sections 128A and 128B is possible so that the two gears in each rotary section rotate at the same speed but at a different speed from the two gears in the other rotary section, which two gears rotate at the same speed.

Figure 11:
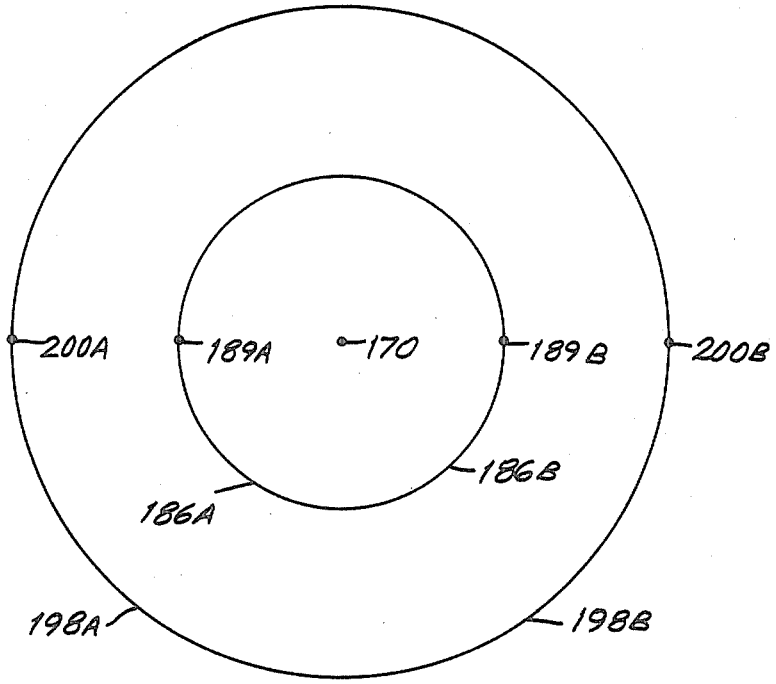
FIG. 11 is a schematic top view of the path of the stirrer shafts of the configuration of the double planetary mixer system shown in FIGS. 9 and 10.

As is indicated in schematic view in FIG. 11, as sun shaft 164 is rotated in a first rotational direction, either clockwise or counterclockwise, sun shaft 164 rotates planetary section 162 in one rotational direction carrying both rotary sections 180A and 180B in the same rotational direction along with first planetary shafts 186A and 186B with their first stirrers 189A and 189B in a first circular orbit around sun axis of rotation 170. At the same time, second planetary shafts 198A and 198B with their second stirrers 200A and 200B are also carried in a second circular orbit greater than the first circular orbit around sun axis of rotation 170. Simultaneously, as sun shaft 164 rotates planetary section 162, first planetary gears 187A and 187B are rotated in the opposite rotational direction by fixed sun gear 164 so as to rotate first and second planetary shafts 198A and 198B about their own axes of rotation 189A and 189B along with stirrers 189A and 189B. First planetary shafts also rotate second planetary shafts 198A and 198B in the same rotational direction about their own axes of rotation 200A and 200B along with stirrers 202A and 202B via drive gears 192A and 192B, idler gears 192A and 192B, and second planetary gears 196A and 196B.

Figure 12:
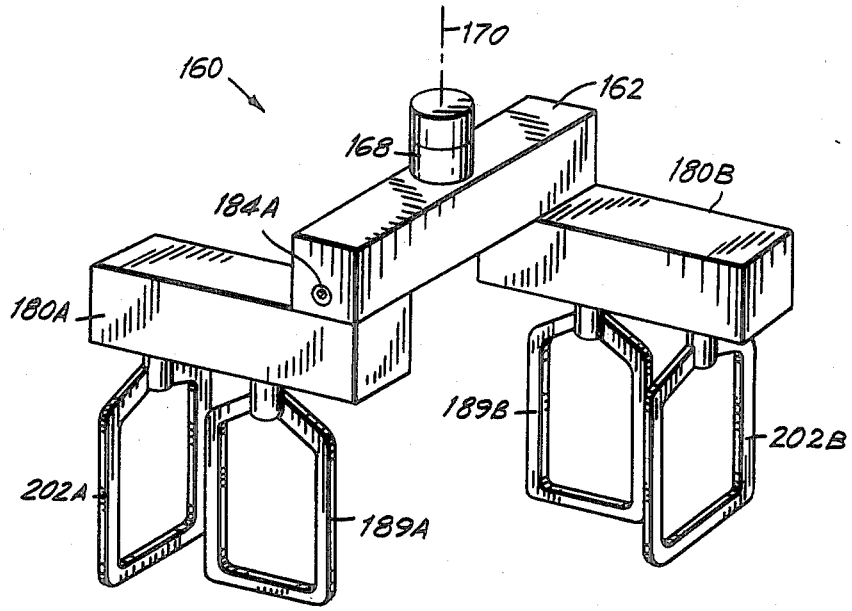
FIG. 12 is a perspective view of the double planetary mixer system with each rotary section rotated 90° relative to the planetary section.

Mixer system 160 is illustrated in perspective view in FIG. 12 with rotary sections 180A and 180B unhinged from their alignment shown in FIG. 9 where they are in elongated alignment with planetary section 162 to an alignment where each rotary section has been rotated to a right angle position relative to and extending in opposite directions from planetary section 162. To achieve the position shown, which is only one of a number of possible configurations of rotary sections 180A and 180B relative planetary section 162, locking pins 184A and 184B were unthreaded from the socket areas of planetary section 162 and from locking recesses 185A and 185B in core segments 182A and 182B, the core segments along with the rotary sections 180A and 180B rotated 90° in the same rotational direction, and locking pins 184A and 184B once again threaded into properly located locking recesses in the core segments. In this position, the stirrers rotate about the axes of their shafts while simultaneously they are rotated in circular orbits about sun axis of rotation 170.

The rotary sections are removable from the planetary section including the mixing implements so that new rotary sections with new mixing implements can be mounted in place of the old ones.

The embodiment of the invention particularly disclosed and described herein is presented merely as an example of the invention. Other embodiments, forms, and modifications of the invention coming within the proper scope and spirit of the appended claims will, of course, readily suggest themselves to those skilled in the art.

What is claimed is:

1. An epicyclic mixer system, comprising, in combination, support means, a first housing fixed to said support means, a second housing connected to said first housing and rotatable about a central axis, first sun drive shaft means positioned in and secured to said first housing, said first sun drive shaft means being rotatable about its own axis which is said central axis and having a cylindrical bore axially aligned with said central axis, second sun drive shaft means mounted in and rotatable within said bore about its own axis which is said central axis, drive means connected to said support means for rotating said first and second sun drive shafts, a first planetary shaft positioned in said second housing and rotatable within said second housing about its own first planetary axis spaced from and parallel to said central axis, said first planetary shaft having opposed ends including one end external of said second housing, first gear means connected to said first planetary shaft and to said first housing for rotating said first planetary shaft about said first planetary axis, a second planetary shaft positioned in said second housing and rotatable within said second housing about its own second planetary axis spaced from and approximately parallel to said first planetary axis, said second planetary shaft having opposed ends including one end external of said second housing, second gear means connected to said second sun drive shaft means and to said second planetary shaft for rotating said second planetary shaft about said second planetary axis, speed control means operatively connected to said drive means and to said first and second gear means for controlling the rotational speed of each said first and second sun drive shaft means independently of the other, said first sun drive shaft means being for rotating said first planetary shaft about said first planetary axis by way of said first gear means, and said second sun drive shaft means being for rotating said second planetary shaft about said second planetary axis by way of said second gear means, said first sun drive shaft means also being for orbiting said second housing with said first and second planetary shafts about said central axis.

2. The epicyclic mixer system according to claim 1, wherein said first gear means includes a first planetary gear and a fixed first sun gear meshed with said first planetary gear, said first planetary gear being connected to the other of said ends of said first planetary shaft and said fixed first sun gear being integral with said first housing, said first sun drive shaft means orbiting said second housing along with said first planetary shaft in one rotational direction about said central axis while simultaneously said first planetary gear is being driven by said fixed first sun gear to rotate said first planetary shaft about said first planetary axis in the opposite rotational direction.

3. The epicyclic mixer system according to claim 2, wherein said second gear means includes a second planetary gear and a second sun gear meshed with said second planetary gear, said second planetary gear being connected to the other of said ends of said second planetary shaft and said second sun gear being connected to said second sun shaft drive means, said first sun drive shaft means orbiting said second housing along with said second planetary shaft in one rotational direction about said central axis while simultaneously said second planetary gear is being driven by said second sun gear to rotate said second planetary shaft about said second planetary axis in the opposite rotational direction.

4. The epicyclic mixer system according to claim 3, wherein said first sun drive shaft means includes an orbit drive shaft having said cylindrical bore and key means for locking a orbit drive shaft to said first housing, and wherein said second sun drive means is a central drive shaft rotatably positioned in said bore and secured to said second sun gear.

5. The epicyclic mixer system according to claim 4, wherein said first housing includes an outer surface aligned with said first planetary gear, said fixed first sun gear being located at said outer surface and extending annularly around said first housing, said first sun gear meshing with said first planetary gear.

6. The epicyclic mixer system according to claim 1, further including first and second mixing implements connected to said one ends of said first and second planetary shafts, respectively.

7. An epicyclic mixer system, comprising, in combination, support means, a first housing rotatable about a central axis passing through said first housing, at least one second housing adjustably fixed to said first housing, sun drive shaft means positioned in and secured to said first housing, said sun drive shaft means being rotatable about its own axis, which is said central axis, said sun drive shaft means being for orbiting said first and second housings about said central axis, drive means connected to said support means for rotating said sun drive shaft means about said central axis, a first planetary shaft positioned in said second housing and being rotatable about its own first planetary axis spaced from and parallel to said central axis, said first planetary shaft having opposed ends including one end external of said second housing, said first planetary shaft being orbited with said second housing about said central axis at a radial first distance from said central axis, first gear means connected to said first-planetary shaft and to said first housing for rotating said first planetary shaft about said first planetary axis, a second planetary shaft positioned in said second housing and being rotatable about its own second planetary axis spaced from and parallel to said central axis and said first planetary shaft, said second planetary shaft having opposed ends including one end external of said second housing, said second planetary shaft being orbited with said second housing about said central axis at a second radial distance, second gear means operatively connected to said first planetary shaft and to said second planetary shaft for rotating said second planetary shaft about said second planetary axis, and adjusting means associated with said first and second housings for positioning said second housing relative to said second housing wherein said first and second radial distances can be selectively varied, whereby said mixer system can be adapted to operate in tanks of different diameters throughout the entire volume of the tank.

8. The epicyclic mixer system according to claim 7, wherein said first gear means includes a first planetary gear and a fixed sun gear meshed with said first planetary gear, said first planetary gear being positioned in said second housing and connected to the other of said ends of said first planetary shaft, and said fixed sun gear being positioned in said first housing and secured to said support means and being aligned with said sun drive shaft means and connected to said sun drive shaft means, said sun drive shaft means orbiting said first and second housings along with said first planetary shaft in one circular direction about said central axis while simultaneously said first planetary gear is being driven by said fixed sun gear to rotate said first planetary shaft about said first planetary axis in the same circular direction.

9. The epicyclic mixer system according to claim 8, wherein said second gear means includes a drive gear, an idler gear meshed with said drive gear, and a second planetary gear meshed with said idler gear, said drive gear being positioned in said second housing and connected to said first planetary shaft, said idler gear being positioned in said second housing, and said second planetary gear being connected to the other of said ends of said second planetary shaft, said first planetary shaft driving said idler gear in an opposite circular direction, and said idler gear driving said second planetary gear to rotate about said second planetary axis in the same circular direction as said first planetary axis.

10. The epicyclic mixer system according to claim 9, wherein said adjusting means is in the form of said first housing forming a cylindrical socket, said second housing having a cylindrical core portion rotatably and removably positioned in said socket, said first housing having a wall portion defining a part of said socket, said wall forming a threaded locking hole, said core portion forming a plurality of locking recesses each adapted to be aligned with said locking hole, and a threaded locking pin positioned in said locking hole and having an inner end removably positioned in a selected locking recess, said core portion being rotatable in said socket when said locking pin is withdrawn from said selected locking recess, said core portion being rotatable in said socket to a new alignment for positioning of said inner end of said locking pin in another selected recess, whereby said second housing may be adjusted so as to change said radial first and second distances to fit the dimensions of tanks of different diameters.

11. The epicyclic mixing system of claim 10, wherein said first planetary gear and said other end of said first planetary shaft being positioned in said core portion.

12. The epicyclic mixing system of claim 11, further including another second housing adjustably fixed to said first housing, said second housing and said another housing being positioned on opposite sides of said central axis.

13. The epicyclic mixing system of claim 7, further including first and second mixing implements attached to said one ends of said first and second planetary shafts, respectively.

14. The epicyclic mixing system of claim 12, wherein at least one of said second housings is removable from said first housing.

15. The epicyclic mixing system of claim 13, wherein at least one of said second housings including said mixing implements is removable as a unit from said first housing, whereby a new second housing including new mixing implements may be mounted in place thereof.

* * * * *